US007011463B2

(12) United States Patent
Matsuse

(10) Patent No.: US 7,011,463 B2
(45) Date of Patent: Mar. 14, 2006

(54) PRINTER

(75) Inventor: Toshiya Matsuse, Shiojiri (JP)

(73) Assignee: Seiko Epson Corporation, (JP)

( * ) Notice: Subject to any disclaimer, the term of this patent is extended or adjusted under 35 U.S.C. 154(b) by 0 days.

(21) Appl. No.: 10/798,107

(22) Filed: Mar. 10, 2004

(65) Prior Publication Data

US 2004/0234316 A1 Nov. 25, 2004

(30) Foreign Application Priority Data

Mar. 10, 2003 (JP) ..... 2003-063356

(51) Int. Cl.
*B41J 11/48* (2006.01)

(52) U.S. Cl. ..... 400/594; 400/512; 400/619; 400/693

(58) Field of Classification Search ..... 400/512, 400/594, 619, 611, 693; 242/563
See application file for complete search history.

(56) References Cited

U.S. PATENT DOCUMENTS

| | | | |
|---|---|---|---|
| 5,820,068 | A | 10/1998 | Hosomi et al. |
| 5,833,380 | A | 11/1998 | Hosomi et al. |
| 5,884,861 | A | 3/1999 | Hosomi et al. |
| 6,118,469 | A | 9/2000 | Hosomi et al. |
| 6,511,240 | B1 | 1/2003 | Yamada |
| 6,565,273 | B1 | 5/2003 | Yamada |
| 2002/0021930 | A1 | 2/2002 | Yamada |

FOREIGN PATENT DOCUMENTS

| | | | |
|---|---|---|---|
| JP | 05-177908 | | 7/1993 |
| JP | 9-295436 | | 11/1997 |
| JP | 2000-289272 | | 10/2000 |
| JP | 2001-088987 | | 4/2001 |
| JP | 2001-171866 | | 6/2001 |
| JP | 2001-171869 | | 6/2001 |
| JP | 2001-310845 | | 11/2001 |
| JP | 2002-30222 | | 1/2002 |
| JP | 2002-128331 | | 5/2002 |
| JP | 2002-338095 | * | 11/2002 |

OTHER PUBLICATIONS

Korean Examination Report dated Sep. 23, 2005 which issued in the corresponding Korean Patent Application.

* cited by examiner

*Primary Examiner*—Andrew H. Hirshfeld
*Assistant Examiner*—Marissa Ferguson
(74) *Attorney, Agent, or Firm*—Anderson Kill & Olick

(57) ABSTRACT

A printer having a roll paper compartment 8 for housing a recording paper roll and a movable divider 83 for adjustably setting one side of the roll paper compartment 8 to adjustably accommodate different widths of roll paper and to facilitate placement of a remaining paper detector 90 in the roll paper compartment 8 for detecting how much paper remains on the paper roll. The divider facilitates installation of an after market remaining paper detector in the printer. The remaining paper detector can be positioned at a plurality of different angular positions around an axis of rotation substantially parallel to the widthwise direction of the printer. The roll paper compartment 8 of the printer 1 has a bottom 81 and a fixed side panel 82 for defining the other side of the roll paper compartment. The divider 83 is removably connected to the bottom 81, and can be selectively fixed to any one of a multiple number of positions along the width of the printer parallel to the longitudinal axis thereof.

1 Claim, 13 Drawing Sheets

(a)

(b)

PRINTER

BACKGROUND OF THE INVENTION

1. Field of Technology

The present invention relates generally to a receipt printer or other type of printer used in a POS system, and relates more particularly to a printer in which a remaining paper detector is removably installed for detecting how much paper remains on a paper roll in the roll paper compartment.

2. Description of Related Art

Paper rolls made by winding a recording paper tape as a recording medium onto a core are commonly used in receipt printers. A paper roll is then housed in a roll paper compartment, the paper is pulled from the roll and printed using a thermal print head, for example, and the printed paper is then cut to a suitable length by a paper cutter for issuance as a receipt. To make replacing the roll paper easier, some printers of this type have the paper roll set directly on the bottom of the roll paper compartment and pull the paper tape from the compartment with the paper roll rotating directly against the compartment bottom rather than passing a spindle through the core of the roll and rotatably supporting the roll on this spindle.

So that different widths of roll paper can be used in printers using this type of roll paper compartment, Japanese Unexamined Patent Appl. Pub. 2002-3022 teaches a printer in which one side of the roll paper compartment is a movable divider. This divider can be moved widthwise to the printer and set to the width of roll paper loaded in the roll paper compartment.

Printers that have a remaining paper detector in the roll paper compartment for detecting when the amount of paper left on the roll declines to a specific threshold level are also known. One such remaining paper detector has a detector element that enters the hollow core of the paper roll when the amount of paper left on the roll drops to a predefined level. When this detector element enters the hollow core, a switch operates to output a signal indicating that there is only a little paper left. See, for example, Japanese Unexamined Patent Appl. Pubs. 2002-3022 and H09-295436.

Obviously not all receipt printers, for example, have a remaining paper detector pre-installed in the roll paper compartment, and there are therefore cases in which a remaining paper detector (also called a near-end detector) is later added.

If the remaining paper detector operates by means of a detector element that enters the hollow core of the paper roll, it may also be necessary to adjust the height and orientation of the detector element according to the attitude of the printer, for example, so that the detector operates correctly.

SUMMARY OF THE INVENTION

An object of the present invention is therefore to provide a printer that simplifies after-market installation of a remaining paper detector and adjusting the installation position of the remaining paper detector.

To achieve this object, a printer according to the present invention has a roll paper compartment for housing a recording paper roll. This roll paper compartment has a bottom panel; a fixed side panel defining one side of the roll paper compartment widthwise to the printer; and a divider defining an other side of the roll paper compartment widthwise to the printer. The divider is removably assembled to the bottom panel and has a detector mounting part for removably installing a remaining paper detector. The remaining paper detector is used to detect if an amount of paper remaining on a paper roll stored in the roll paper compartment is less than or equal to a predetermined amount.

This aspect of the invention provides a mounting part for a remaining paper detector on a removable divider. To install the remaining paper detector, the divider is removed from the roll paper compartment, the remaining paper detector is then installed to the mounting part of the divider, and the divider is then reinstalled to the roll paper compartment. Installing an after-market remaining paper detector is therefore easier compared with other configurations in which the remaining paper detector is installed to a fixed location inside the roll paper compartment of the printer.

In order to accommodate paper rolls of different widths, the divider can be assembled to the bottom panel positioned to one of multiple positions widthwise to the printer.

In this case the divider preferably has a plurality of protruding pins or recessed holes, and the bottom panel has a set of holes for inserting the pins, or a set of pins for insertion into the recessed holes, at the multiple positions widthwise to the printer. This enables the divider to be easily fixed at one of multiple positions widthwise to the printer.

Yet further preferably, the printer has a remaining paper detector removably installed to the detector mounting part of the divider.

This remaining paper detector preferably has a detector element positioned at a specified height from the bottom panel. This detector element contacts a side of the roll paper stored in the roll paper compartment, and enters the hollow core of the paper roll when the remaining roll paper drops below a predetermined level.

The outside diameter of the hollow core of commercially available recording paper rolls is typically 18 mm or 22 mm. To accurately detect the near-end of roll paper wound to either size of core, the remaining paper detector is preferably installed to the divider so that the detector element height can be adjusted.

While this printer is typically placed horizontally, it could be used in a vertical orientation, which case the back end of the printer becomes the bottom. This makes it necessary to change the position of the detector element of the remaining paper detector. The remaining paper detector is therefore further preferably installed to the divider so that the detector element can be positioned to a plurality of angular positions around an axis of rotation substantially parallel to the widthwise direction of the printer.

A further aspect of the invention is a printer having a compartment for holding roll paper. This compartment has a fixed first side against which the roll paper is set, and an adjustable second side that is movable to the printer according to the roll paper width. The printer has a roll paper near-end detector disposed to said second side.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of a printer according to the present invention is described below with reference to the accompanying figures.

(General Configuration)

Figure 3:
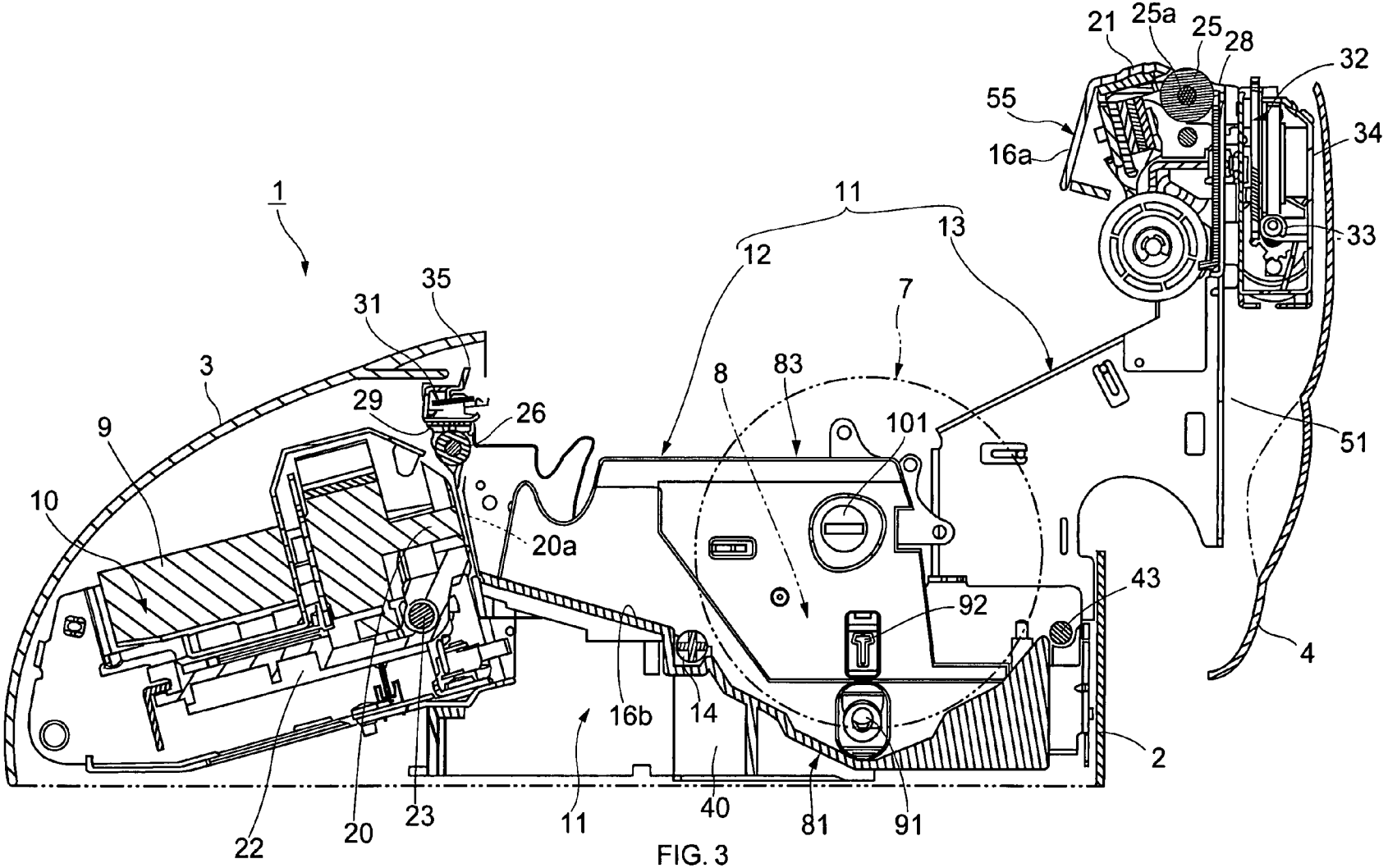
FIG. 3 is a schematic longitudinal section view of the printer shown in FIG. 1 with the cover open.

As shown in these figures, a printer 1 according to the present invention has a rectangular case frame 2 enclosing the four sides of the printer 1, a front cover 3 that covers the top front and a back cover 4 that covers the top back part of the printer 1. Together these parts form the printer case. A printer unit 11 is assembled into this printer case, and a paper exit 5 is formed between the front and back covers 3, 4. Operating a sliding button 6 releases a locking mechanism (not shown in the figure) so that the back cover 4 can be opened to the back as shown in FIG. 3. Roll paper 7 is held in a compartment 8 in the printer unit 11, and opening the back cover 4 opens the roll paper compartment 8 so that the roll paper 7 can be replaced. A ribbon cassette 9 holding the ink ribbon for the printer unit 11 is loaded to a loading unit 10. Opening the front cover 3 similarly exposes this loading unit 10 so that ink ribbon cassette 9 can be replaced.

The internal structure of the printer 1 is described next.

Figure 1:
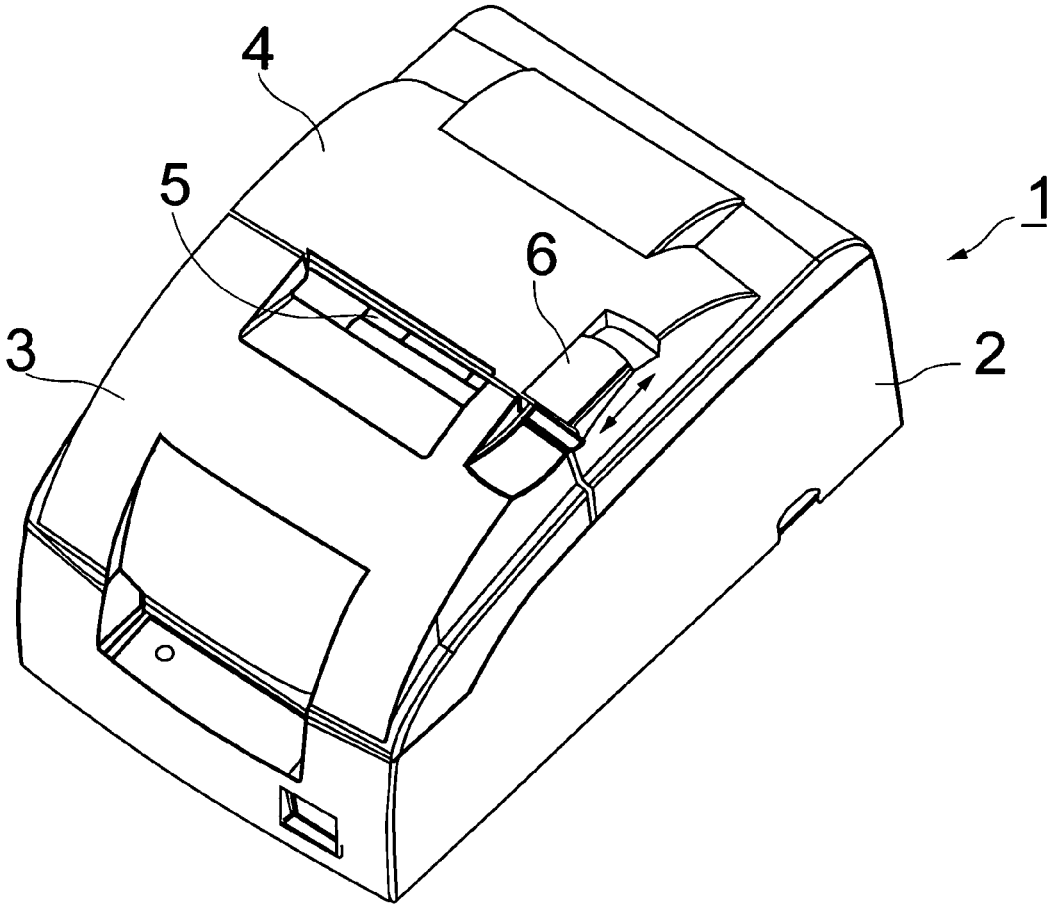
FIG. 1 is an oblique external view of a printer according to the present invention.
Figure 2:
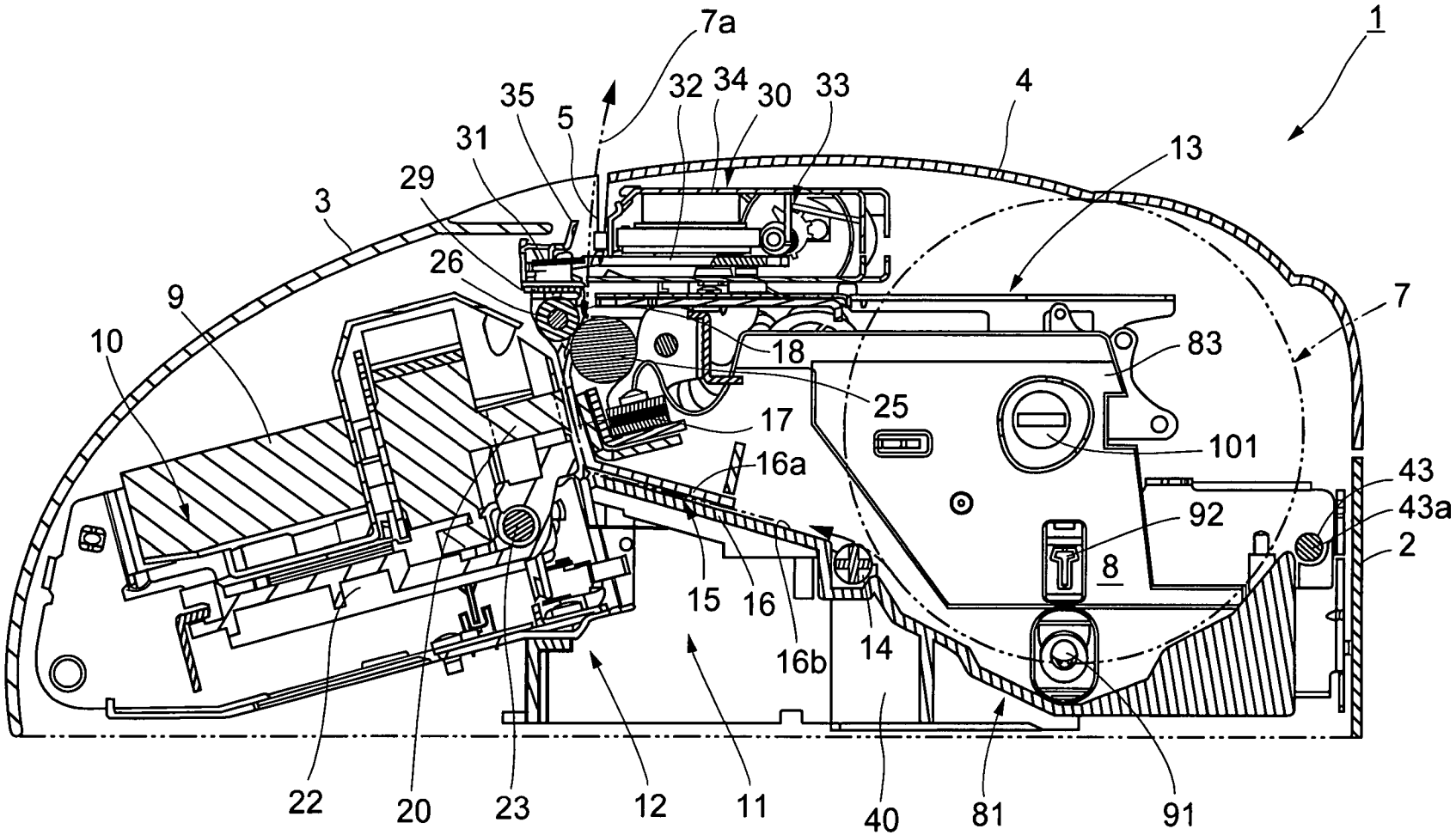
FIG. 2 is a schematic longitudinal section view of the printer shown in FIG. 1.

The roll paper 7 compartment 8 formed in the back of the printer unit 11 has a substantially curved bottom that is open to the top when seen from the side as shown in FIG. 2. Recording paper 7*a* pulled from a paper roll 7 held in the compartment 8 passes guide roller 14 at the front of the compartment 8 and is guided to the paper transportation path 15. The paper transportation path 15 has a first inclined path part 16 that slopes gradually upward from the back to the front of the printer, a second inclined path part 17 that rises at a sharp angle from the front end of the first inclined path part 16, and a third inclined path part 18 that slopes from the top end of the second inclined path part 17 toward the back of the printer 1 and leads to the paper exit 5. Note that the recording paper 7*a* is indicated by a dotted line in FIG. 2 and FIG. 4.

The first inclined path part 16 is composed of a transportation guide 16*a* and an opposing transportation surface 16*b*. The second inclined path part 17 downstream from the first inclined path part 16 is composed of the print head surface 20*a* of a dot impact print head 20, and a platen 21 that is opposite the print head surface 20*a* with a specific gap therebetween. The second inclined path part 17 is thus where the roll paper is printed by the print head 20, and is also referred to as the printing position herein. The print head 20 is disposed so that the head surface 20*a* is inclined and faces up and toward the back of the printer 1. The platen 21 is rendered such that the platen surface is inclined facing downward and to the front of the printer corresponding to the angle of the print head 20. The print head 20 is mounted on a head carriage 22. The head carriage 22 travels bidirectionally widthwise to the printer along a carriage guide shaft 23.

The loading unit 10 for the ink ribbon cassette 9 is formed on the top of the head carriage 22. The ribbon cassette loading unit 10 is also inclined rising upward toward the back of the printer 1.

As a result, the ink ribbon 9*a* delivered from an ink ribbon cassette 9 installed to the ribbon cassette loading unit 10 travels parallel to and between the print head 20 and platen 21.

The third inclined path part 18 continuing from the second inclined path part 17 is described by a transportation guide 28 curving to the back of the printer 1 from the top end of platen 21. Disposed along this third inclined path part 18 is a paper transportation mechanism composed of paper feed roller 25, pressure roller 26, and torsion bar 27 as an urging means pushing the pressure roller 26 to the paper feed roller 25. The paper feed roller 25 is located at the back side of the third inclined path part 18. The pressure roller 26 is supported in front of the paper feed roller 25 on a roller mounting plate 29 so that the pressure roller 26 can move toward the paper feed roller 25, and is constantly urged by the spring force of the torsion bar 27 toward the paper feed roller 25.

Recording paper 7*a* pulled from the roll paper 7 is held between the paper feed roller 25 and pressure roller 26, and is conveyed through the paper transportation path 15 by rotation of the paper feed roller 25 by a drive means not shown. It should be noted that the platen 21 and transportation guide 16*a* communicating with the bottom of the platen 21 are formed by a platen frame 55, which is a discrete part, and the transportation guide 28 is assembled to the top end of this platen frame 55.

A scissors-type automatic cutter unit 30 for cutting the recording paper is disposed near the paper exit 5. This automatic cutter unit 30 is composed of a fixed knife 31 located on one side (the front) and a movable knife 32 on the other side (the back) of the paper transportation path, and a drive mechanism 33 for operating the movable knife 32. The movable knife 32 and drive mechanism 33 are housed in a case 34. Recording paper 7*a* held between the fixed knife 31 and movable knife 32 is cut by the movable knife 32 sliding across the fixed knife 31.

Another knife 35 for manually cutting the recording paper 7*a* is rendered at the front edge of the paper exit 5.

Figure 5:
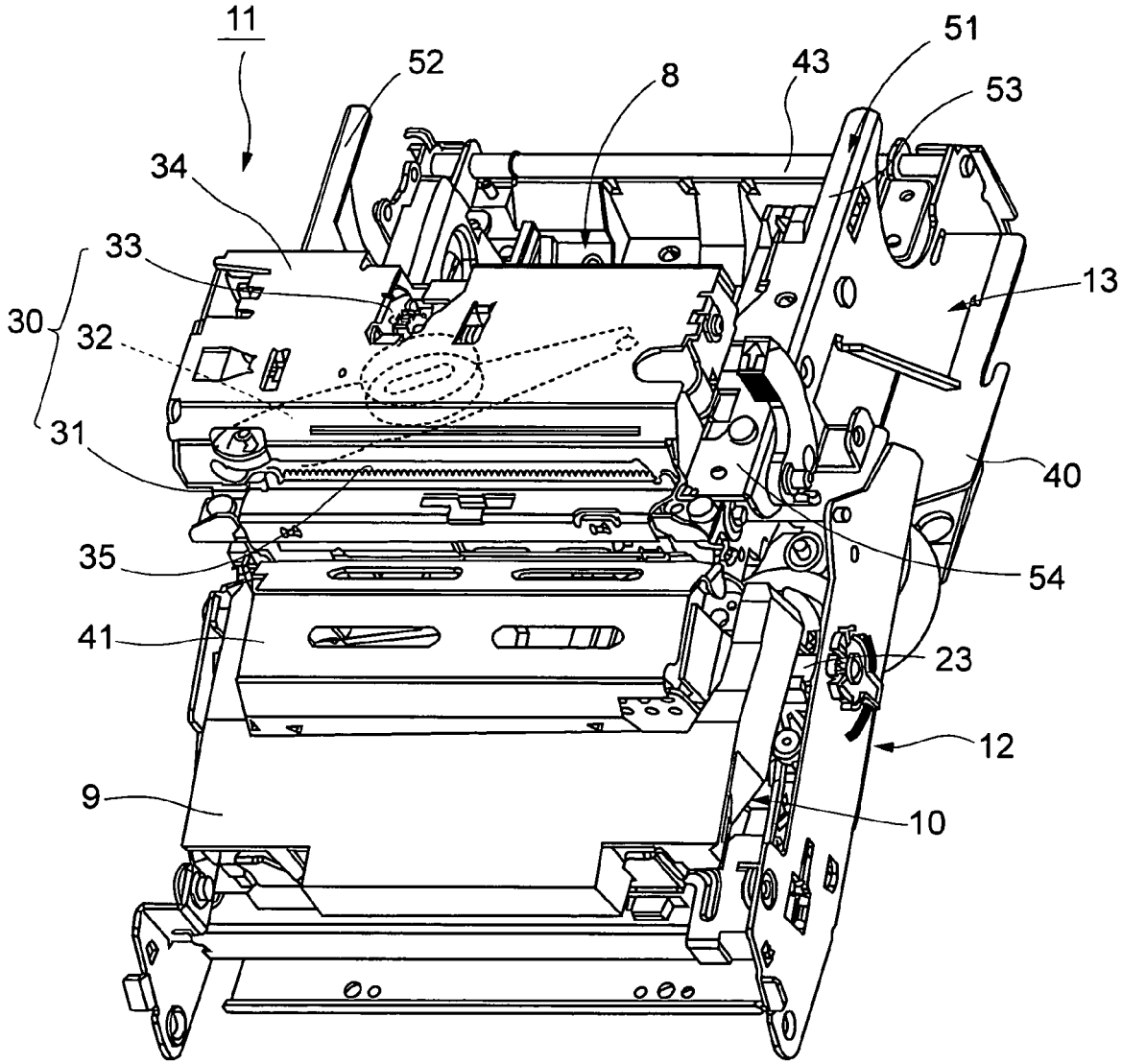
FIG. 5 is an oblique view of the printer unit assembled into the printer shown in FIG. 1.
Figure 6:
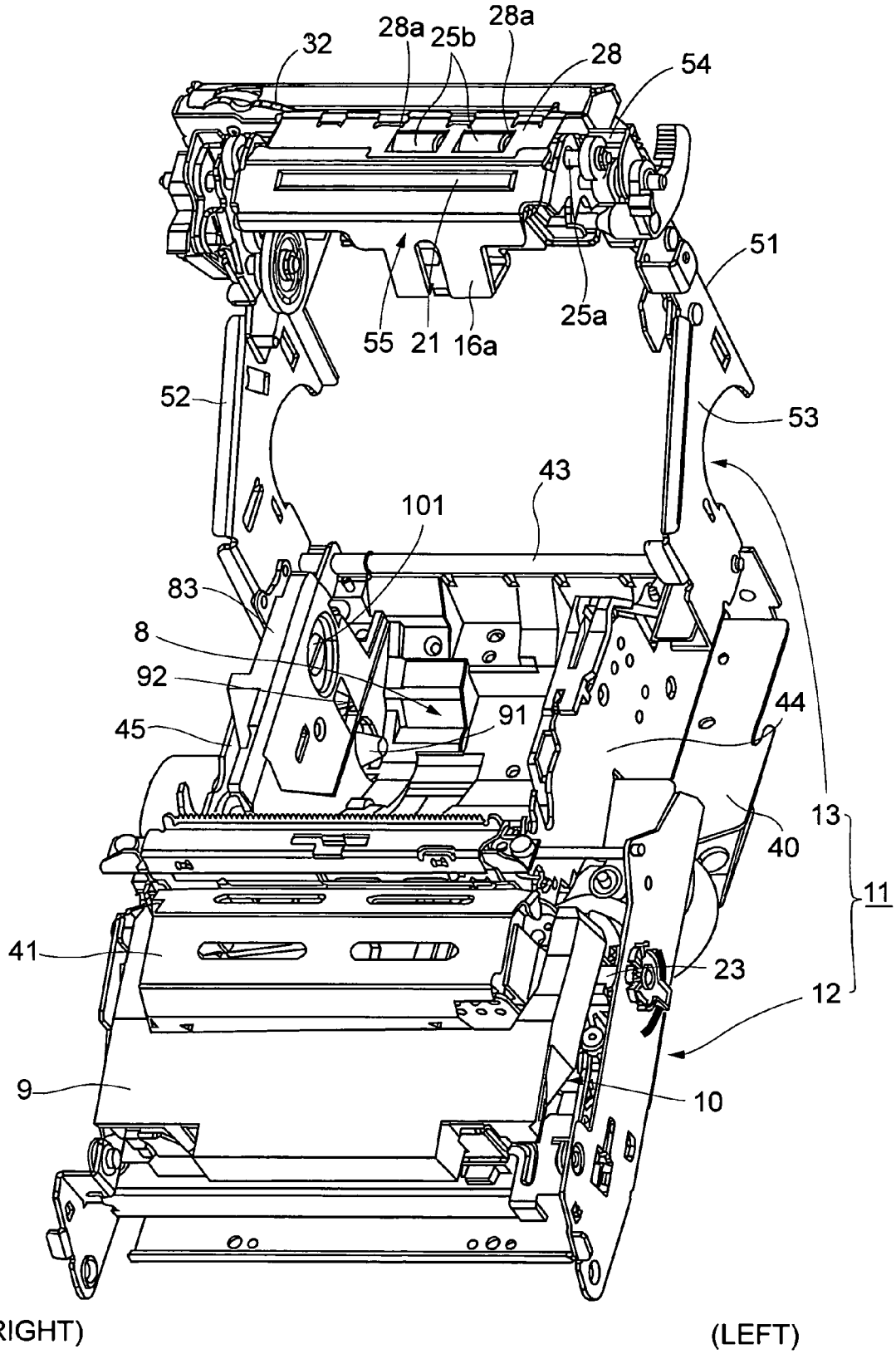
FIG. 6 is an oblique view showing the opening unit of the printer unit shown in FIG. 5 open.

FIG. 5 is an oblique view of the printer unit 11 assembled into the printer case. The printer unit 11 is composed of a stationary unit 12 and an opening unit 13. The opening unit 13 is pivotably supported on the stationary unit 12 so that the opening unit 13 can rotate open and closed on an axis of rotation at the back of the unit. FIG. 6 is an oblique view showing the opening unit 13 open.

To facilitate replacing the roll paper 7 in this printer unit 11, opening the back cover 4 of the roll paper compartment 8 also opens the paper transportation path 15 configured as described above. As a result, the components of one side of the paper transportation path 15 are assembled to the stationary unit 12, and the back cover 4 and components of the other side of the paper transportation path 15 are assembled to the movable opening unit 13. As a result, opening the opening unit 13 opens the roll paper 7 compartment 8 as well as the paper transportation path 15.

More specifically, the roll paper compartment 8, transportation surface 16*b* of first inclined path part 16, print head 20, pressure roller 26, and fixed knife 31 of automatic cutter unit 30 are assembled to the stationary unit 12. The platen frame 55 of first inclined path part 16, second inclined path part 17, and third inclined path part 18 (that is, transportation guide 16*a* and platen 21), transportation guide 28, paper feed roller 25, movable knife 32 of automatic cutter unit 30, drive mechanism 33, and back cover 4 are assembled to the opening unit 13 as shown in FIG. 3.

This configuration assures that the opening unit 13 can still be opened even if there is a problem with the movable knife 32, such as the movable knife 32 stopping while crossing the fixed knife 31, because the movable knife 32 is located above the fixed knife 31.

As will be known from FIG. 3 and FIG. 6, when the opening unit 13 is fully open, the roll paper 7 can be loaded by the extremely simple operation of simply dropping the roll paper 7 into the compartment 8 from above. Furthermore, because the paper transportation path 15 is open at this time, the recording paper 7*a* can be threaded through the paper transportation path 15 by the extremely simple operation of simply pulling the recording paper 7*a* from the roll paper 7 along the paper transportation path 15.

Figure 4:
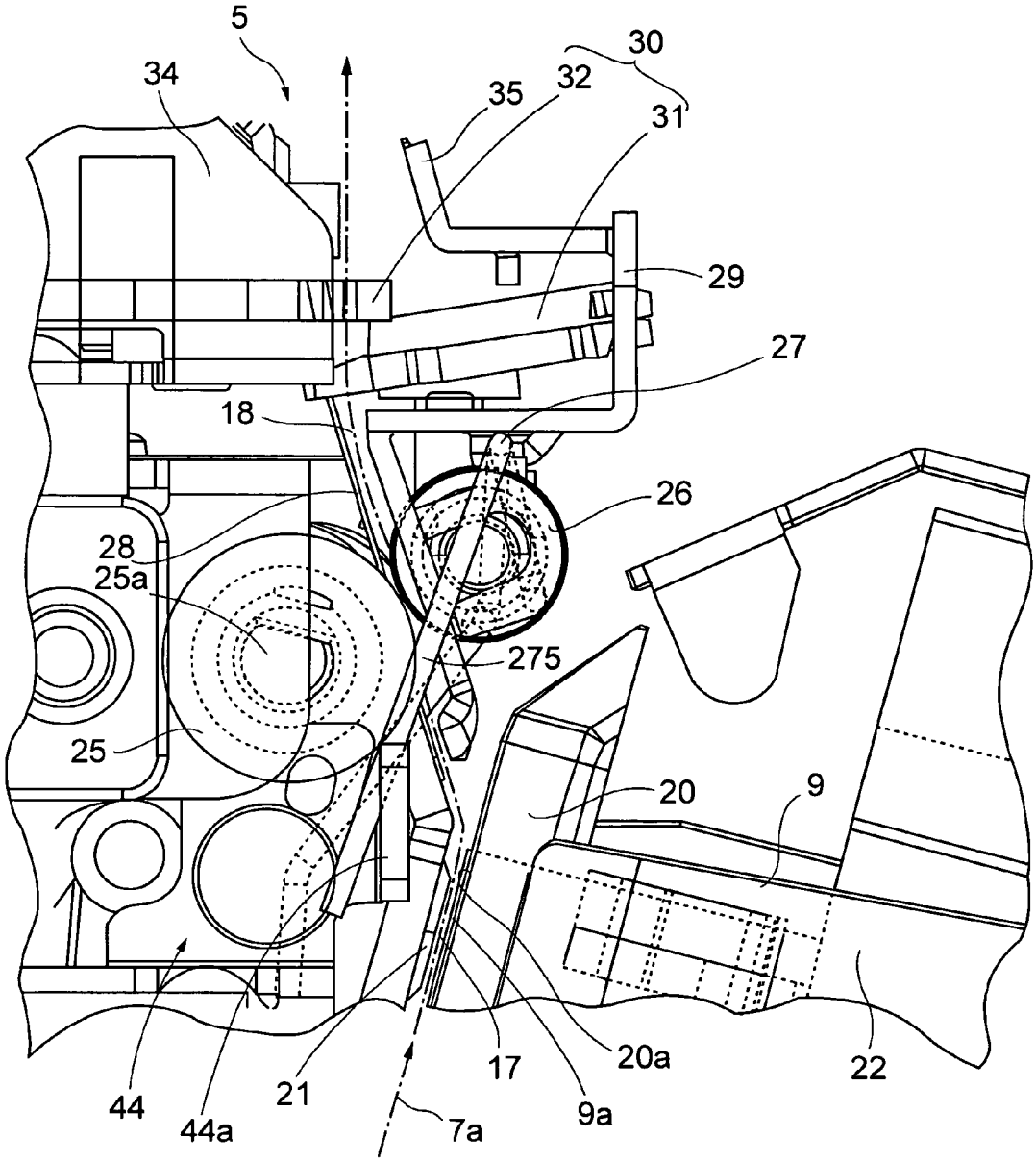
FIG. 4 is an enlarged partial section view showing the paper feed mechanism of the printer shown in FIG. 1.

When the opening unit 13 is then closed, restoring the arrangement shown in FIG. 2, FIG. 4, and FIG. 5, the recording paper 7*a* is automatically loaded between the print head 20 and platen 21 and between the paper feed roller 25 and pressure roller 26 with the end of the recording paper 7*a* protruding externally from the paper exit 5.

The stationary unit 12 and opening unit 13 are described in detail next.

The stationary unit 12 has a main frame 40, and the carriage guide shaft 23 is disposed widthwise to the front of the main frame 40. As noted above, this carriage guide shaft 23 supports the head carriage 22 carrying the print head 20 so that the head carriage 22 can travel bidirectionally along the guide shaft 23. A ribbon frame 41 is disposed covering the head carriage 22 and print head 20. The outside perimeter of this ribbon frame 41 is the loading unit 10 for the ink ribbon cassette 9.

The compartment 8 for loading the roll paper 7 is formed at the back part of the main frame 40, and a shaft 43 on which the opening unit 13 pivots is disposed at the back of the compartment 8 widthwise to the main frame 40.

The opening unit 13 has an opening frame 51 composed of right and left arms 52, 53 extending front-back, and a front connecting bracket 54 linking the front ends of these arms 52, 53. The back ends of these right and left arms 52, 53 are freely rotatably supported by the ends of the pivot shaft 43. The platen frame 55 is affixed to the front of the front connecting bracket 54 of the opening frame 51, and paper feed roller shaft 25*a* is assembled therebehind. The outside surfaces of two paper feed rollers 25*b* affixed coaxially to the paper feed roller shaft 25*a* protrude to the front from openings 28*a* formed in the transportation guide 28 of platen frame 55. The movable knife 32 and drive mechanism 33 of the automatic cutter unit 30 are mounted on the front connecting bracket 54 of the opening frame 51.

As will be known from FIG. 2 and FIG. 3, the print head 20 is disposed facing upward at an angle on the stationary unit 12, and the ink ribbon cassette 9 loaded to the loading unit 10 is also disposed at a corresponding angle in the same direction. The platen 21 is disposed on the opening unit 13 side at a downward facing angle so that it is parallel to and equidistant from the head surface 20*a* of the print head 20. The center of rotation for the opening unit 13, that is, the height of the axial center of the shaft 43, is below the head surface 20*a* of the print head 20.

As a result, when the opening unit 13 pivots open from the position where the platen 21 is equidistantly opposite the print head 20 (that is, the closed position of the opening unit 13), the path of the distal end of the opening unit 13, that is, the path of the top and bottom edges of the platen 21 opposite the print head 20, is not a forward or upward direction relative to the head surface 20*a* of the print head 20, but rather an arc moving away from the head surface 20*a* to the back of the printer 1. As a result, when the opening unit 13 opens and closes, this path does not intersect with the print head 20.

Furthermore, because the axis of rotation 43*a* of the opening unit 13 is located below the head surface 20*a* of the print head 20, the movement of the top and bottom edges of the platen 21 toward the back in conjunction with movement of the opening unit 13 is great. This forms a space (an inverted triangle when seen from the side) directly above the printing position 17 through which the opening unit 13 does not travel. This space is used in this embodiment of the invention to locate the pressure roller 26, torsion bar 27, fixed knife 31 of automatic cutter unit 30, and knife 35. This affords a small, compact printer mechanism.

As described above, the loading unit 10 for the ink ribbon cassette 9 is disposed at an incline corresponding to the incline of the print head 20 in this embodiment of the invention. The ink ribbon cassette 9 can therefore be loaded to and removed from the loading unit 10 at an angle from the front of the printer. While the pressure roller 26, fixed knife 31 of automatic cutter unit 30, and knife 35 are located directly above the second inclined path part 17, these do not interfere with loading and unloading the ink ribbon cassette 9. The ink ribbon cassette 9 can therefore be installed or removed by means of a simple one-step operation.

Furthermore, the path of opening unit 13 movement can be changed by adjusting one or both of the inclination angle of the print head 20 and platen 21, and the height of the axis of rotation 43*a* of the opening unit 13. This makes it possible to increase the space directly above the printing position 17 that is not intersected by the top and bottom ends of the platen when the opening unit 13 opens/closes, and thus provides greater freedom for the parts layout.

(Roll Paper Compartment and Remaining Paper Detector)

Figure 7:
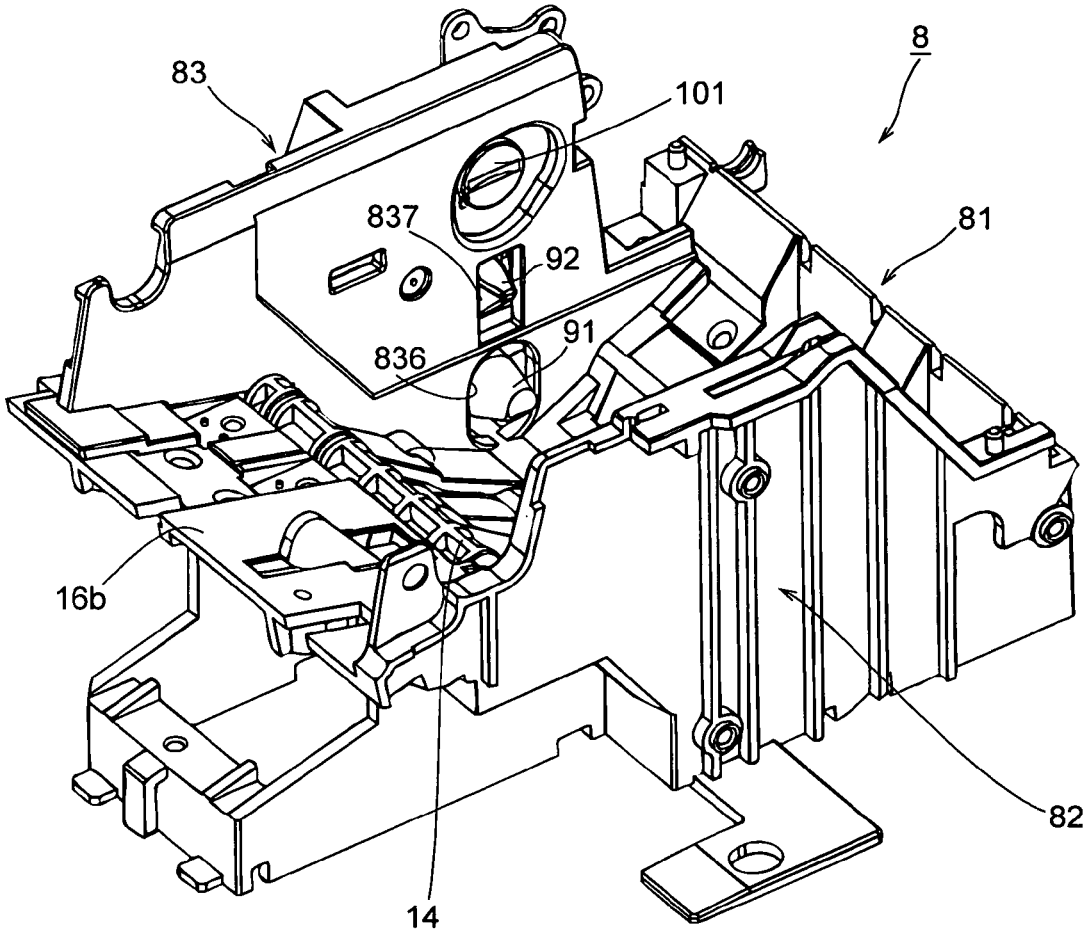
FIG. 7 is an oblique view from the left front side of the roll paper compartment in the printer shown in FIG. 1.
Figure 8:
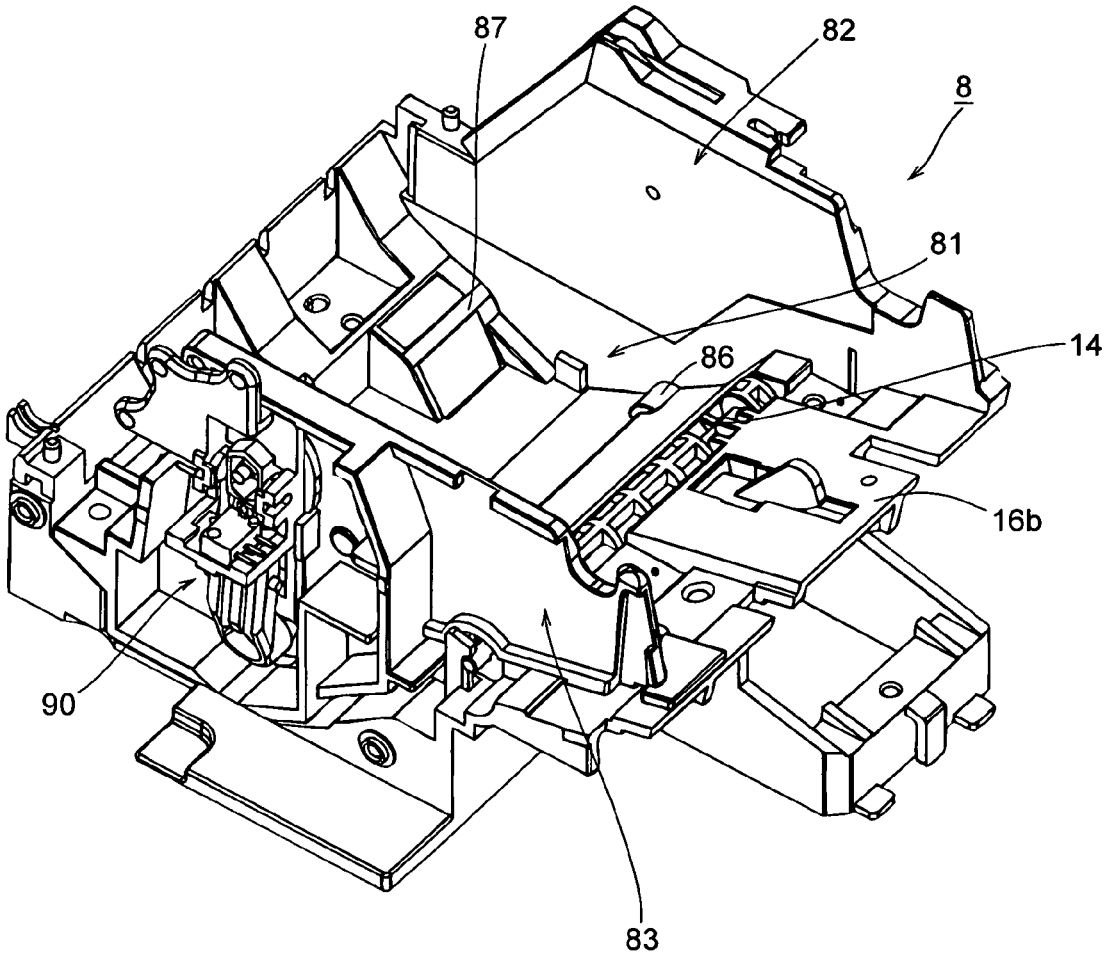
FIG. 8 is an oblique view from the right front side of the roll paper compartment shown in FIG. 7.
Figure 9:
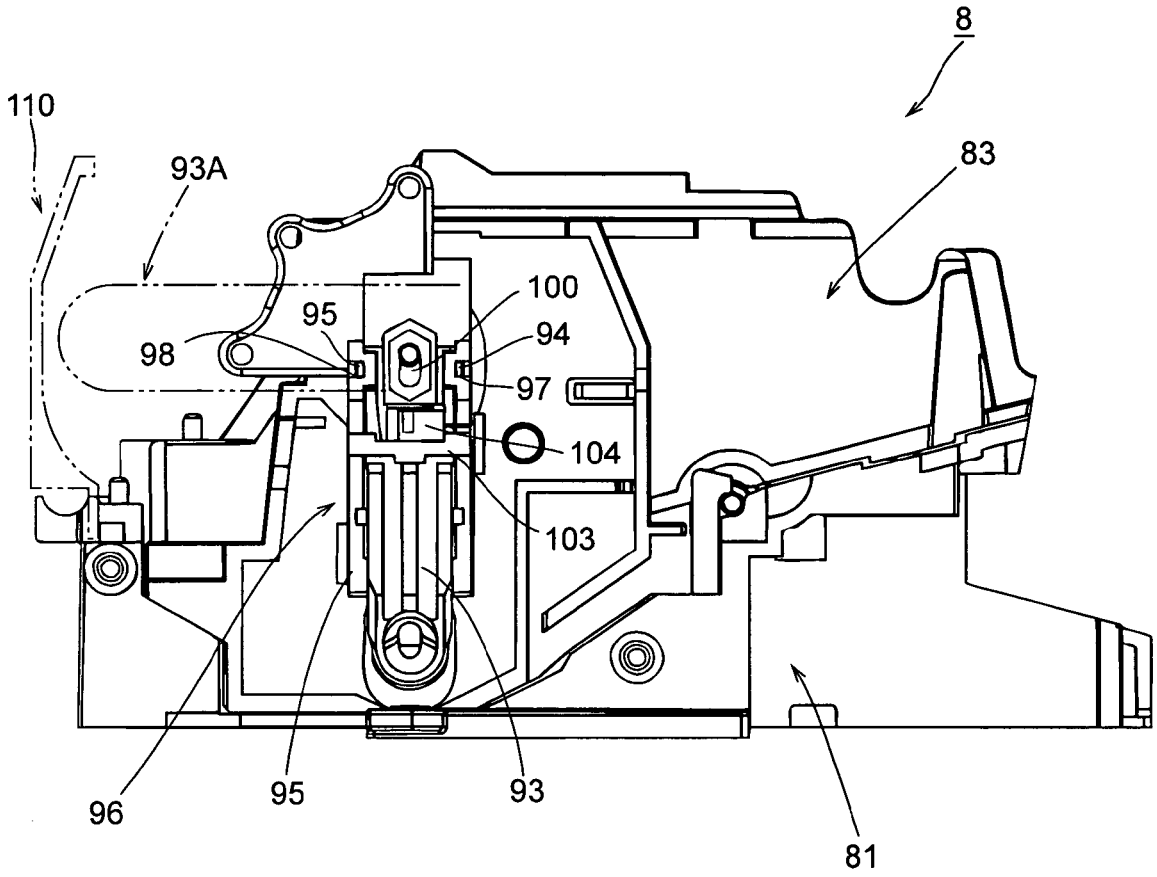
FIG. 9 is a right side view of the roll paper compartment shown in FIG. 7.
Figure 10:
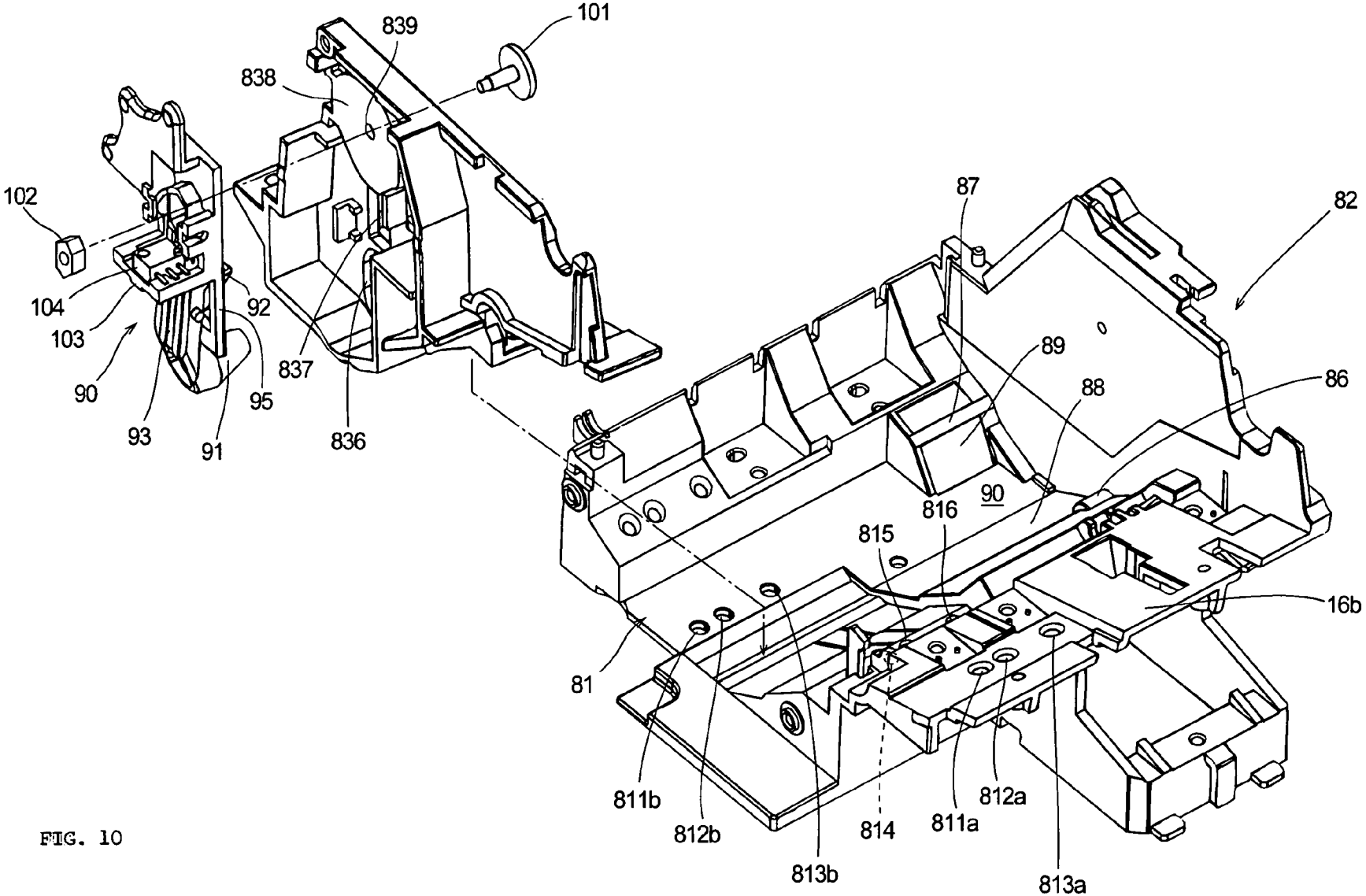
FIG. 10 is a partially exploded oblique view of the roll paper compartment shown in FIG. 7.

FIG. 7 is an oblique view from the left front side of the roll paper compartment 8 provided in the back part of the stationary unit 12, FIG. 8 is an oblique view from the right front side of the roll paper compartment 8, and FIG. 9 is a right side view of the compartment 8. FIG. 10 is a partially exploded view of the compartment 8, FIG. 11 is a partially exploded oblique view showing the divider and remaining paper detector in the roll paper compartment, and FIG. 12 is a right side view of the divider.

Referring to these figures, the roll paper compartment 8 is composed of a bottom 81, a fixed side panel 82 defining the left side wall of the roll paper compartment 8, and an adjustable divider 83 defining the right side of the roll paper compartment 8. The bottom 81 and fixed side panel 82 are a single plastic molding. The divider 83 is a separate plastic molding that can be removably assembled to the bottom 81. A remaining paper detector 90 for detecting when the amount of paper left on the roll paper 7 has dropped to a specified level or less is affixed to the divider 83.

Figure 11:
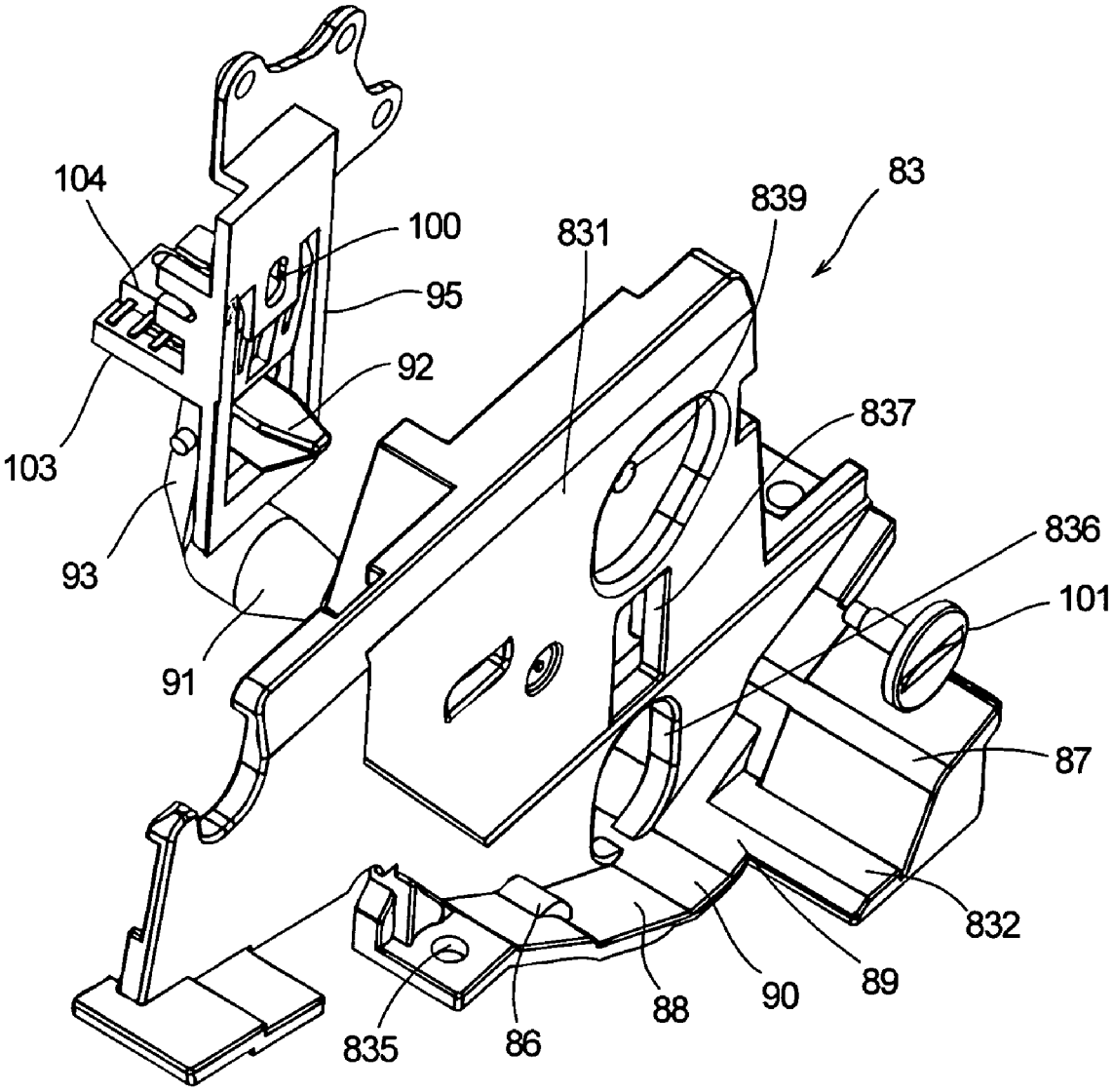
FIG. 11 is a partially exploded oblique view showing the divider and remaining paper detector in the roll paper compartment shown in FIG. 7.
Figure 12:
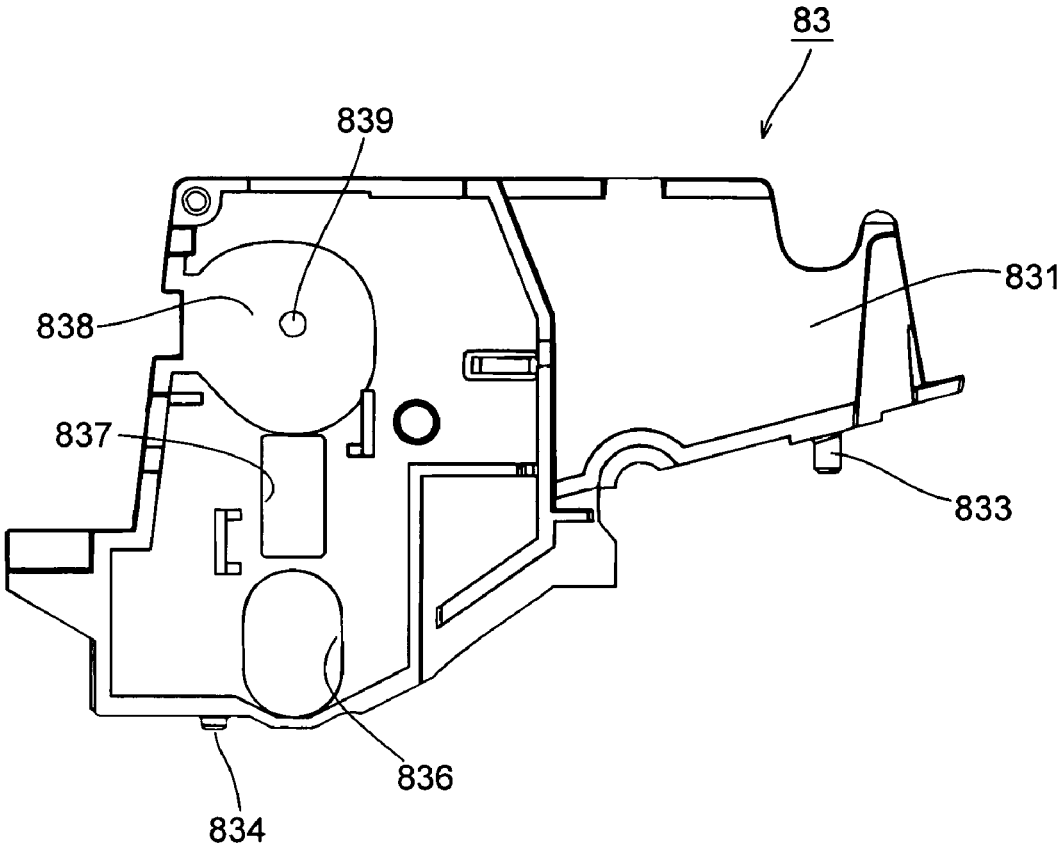
FIG. 12 is a right side view of the divider shown in FIG. 11.

Referring now to FIG. 11 and FIG. 12, the divider 83 has a side member 831 and a bottom member 832 formed to the bottom edge of the side member 831, and insertion pins 833, 834 projecting straight down are formed at the front and back on the bottom of the bottom member 832. Corresponding thereto, as will be known from FIG. 10, a pair of holes 811*a*, 811*b* is formed at the front and back parts near the right edge in the bottom 81. Another similar pair of holes 812*a*, 812*b* is formed to the inside of the compartment from the first set of holes 811*a*, 811*b*, and a third pair of holes 813*a*, 813*b* is formed yet further to the inside from holes 812*a*, 812*b*. The position of the divider 83 on the bottom 81 can thus be adjusted relative to the width of the printer by selectively inserting the insertion pins 833, 834 of this divider 83 in the appropriate pair of holes.

A screw hole 835 is also formed in the bottom member 832 of divider 83 (see FIG. 11), and three corresponding holes 814, 815, 816 (Reference numbers 815, 816 not shown in FIG. 10 or 11) are formed in bottom 81 at appropriate positions widthwise to the printer (see FIG. 10). The divider 83 can thus be removably fixed to the bottom 81 by first inserting the insertion pins 833, 834 of the divider 83 into the selected pair of holes in the bottom 81, and then screwing a screw through screw hole 835 into the corresponding hole 814, 815, 816.

The divider 83 can thus be selectively assembled to one of three positions in a line widthwise to the printer. In other words, the distance between the divider 83 and the opposing fixed side panel 82 of the roll paper compartment 8 can be changed to one of three positions so that three different widths of roll paper 7 can be loaded to the compartment 8 without excessive side-to-side play.

Pairs of support surfaces 86, 87 each having a protruding curved surface for supporting the outside surface of the roll paper 7 are formed on the right and left sides on the front and back sides of the roll paper 7 on the bottom of the compartment 8 defined by bottom 81 and bottom member 832 of divider 83. Between these support surfaces 86, 87 is formed a front/back pair of support surfaces 88, 89 which are inclined relative to the horizontal and function to catch the roll paper 7 when the size of the roll decreases to smaller than the distance between support surfaces 86, 87. These inclined support surfaces 88, 89 are formed widthwise to the printer on the bottom of the compartment 8 across the full width of the compartment. A level surface 90 of a specific width is formed between these inclined support surfaces 88, 89. This level surface 90 determines the maximum depth at the bottom of the compartment 8.

An elliptical opening 836 with the long axis oriented vertically, a rectangular opening 837 with the long sides vertically oriented, and a flat detector mounting surface 838 recessed from the outside in the widthwise direction of the printer are formed in order from bottom to top in the side member 831 of the divider 83 starting from the level surface 90. A screw hole 839 for fastening a remaining paper detector 90 is formed in the center of the detector mounting surface 838.

The remaining paper detector 90 is mounted to the outside surface of the side member 831 of divider 83, and comprises a detector element 91 and stud 92 shaped like a truncated pyramid. The detector element 91 projects to the inside of the compartment 8 from the outside of the bottom opening 836 in side member 831, and stud 92 projects to the inside of the compartment 8 from the outside of the top opening 837. In this embodiment of the invention the detector element 91 and stud 92 are unitarily formed to a single pivoting lever 93. A pair of support studs 94, 95 projecting in the front/back direction of the printer are unitarily formed at the top end of pivoting lever 93. A pair of bearing channels 97, 98 is formed in the front and back edges of the top part of rectangular mounting frame 96. The support studs 94, 95 are supported rotatably to the width of the printer in these bearing channels 97, 98. A mounting hole 100 is formed in the middle at the top of the mounting frame 96. This mounting hole 100 is vertically long and is shaped like an hourglass or a cocoon with a constricted waist. The mounting frame 96 is fixed to the divider 83 by passing a detector mounting screw 101 from the inside of the divider 83 through the screw hole 839 and the top or bottom end of the mounting hole 100, and then tightening a nut 102 onto the outside end of this screw 101.

Passing the screw 101 through at the top end of the mounting hole 100 lowers the remaining paper detector 90 relative to the divider 83 so that the detector element 91 is at the bottom. This position corresponds to paper rolls wound to a core with a small outside diameter. Conversely, passing the screw 101 through the bottom end of the mounting hole 100 raises the remaining paper detector 90 relative to the divider 83 and sets the detector element 91 at the top position. This position corresponds to paper rolls with a large diameter core. The height of the detector element 91 and stud 92 can thus be adjusted to two vertical positions.

A support 103 protruding perpendicularly to the outside is formed at the top part of the mounting frame 96, and a limit switch 104 for remaining paper detection is mounted on this support 103. The limit switch 104 is positioned so that the switch pin 105 is level and projects toward the inside in the widthwise direction of the printer. This switch pin 105 constantly contacts a contact face 106 formed on the lever 93 (see FIG. 13). The limit switch 104 is on when the switch pin 105 projects into the compartment 8, and thus outputs a signal indicating that the amount of paper left on the roll has dropped below a specific level. When the switch pin 105 is pressed by the contact face 106 and retracts, the limit switch 104 turns off.

Figure 13:
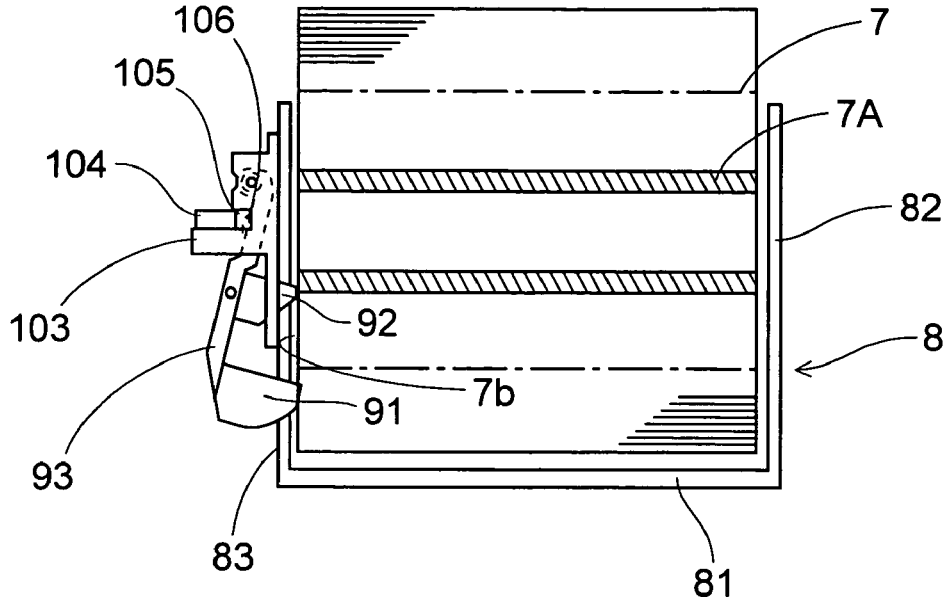
FIG. 13 describes the detection operation of the remaining paper detector in the printer shown in FIG. 1.
Figure 13:
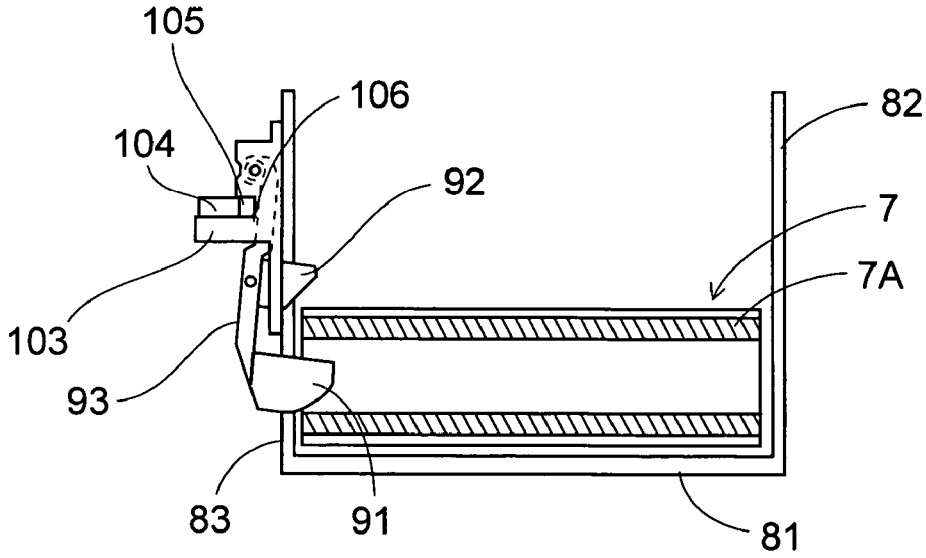

FIG. 13 describes the detection operation of the remaining paper detector 90. The remaining paper detection operation of the remaining paper detector 90 is described next with reference to FIG. 13. When the amount of paper left on the roll paper 7 equals or exceeds a predetermined level, the roll paper 7 is supported by the curved support surfaces 86, 87 in the compartment 8. As shown in FIG. 13(*a*), the core 7A is positioned above the detector element 91 and stud 92, and the detector element 91 and stud 92 touch the side 7*b* of the roll paper 7. The lever 93 on which these are formed is therefore pushed to the outside, the switch pin 105 of limit switch 104 is pushed by the contact face 106 of lever 93, the switch pin 105 thus retracts and the limit switch 104 turns off.

As the recording paper 7*a* is then consumed by printing, the outside diameter of the roll paper 7 gradually decreases and the core 7A descends. When the roll paper 7 moves vertically, the upper stud 92 remains in contact with the side of the roll paper 7. Therefore, as indicated by the dotted line in FIG. 13(*a*), the stud 92 touches the side 7*b* of the roll paper 7 even if the roll paper 7 moves up from the detector element 91 and loses contact therewith. As a result, the detector element 91 will not enter the hollow core 7A of the roll paper 7 and the remaining paper detector 90 will not erroneously detect a near-end state.

When the remaining paper level then drops below a predetermined level, the roll paper 7 drops down between the front/back curved support surfaces 86, 87, and is supported by the pair of front/back inclined support surfaces 88, 89. When the roll paper 7 drops onto these inclined support surfaces 88, 89, the hollow center of the core 7A is positioned opposite the detector element 91. The detector element 91 thus enters the hollow core 7A as shown in FIG. 13(*b*). This causes the limit switch 104 to turn on and output a detection signal indicating that the amount of paper remaining on the roll paper 7 has dropped below the predetermined level, that is, the near-end of the roll has been detected.

If the printer 1 is used in a vertical position with the back end of the printer 1 down, a support plate 110 shaped as indicated by the double-dot dash line in FIG. 9 is attached at the back end of bottom 81 of compartment 8. Parts corresponding to the front/back pair of curved support surfaces 86, 87 and inclined support surfaces 88, 89 disposed to the bottom 81 are also formed on this support plate 110, and when the outside diameter of the roll paper 7 becomes small enough, the roll paper 7 drops between these support surfaces as described above. In this case the remaining paper detector 90 is also rotated 90 degrees to the divider 83 to match the vertical orientation of the printer as indicated by the double-dot dash line 93A in FIG. 9.

The remaining paper detector 90 can be repositioned according to the printer attitude with the divider 83 removed from the bottom 81. Compared with a conventional configuration in which the remaining paper detector 90 is assembled to a fixed side panel 82 formed unitarily with the bottom 81, the configuration of the present invention thus makes it significantly easier to change the orientation of the remaining paper detector 90.

It should be noted that the remaining paper detector 90 shall not be limited to using a limit switch 104, and could be configured to detect how much paper remains on the roll paper 7 by means of an optical detection means, for example. An advantage of using a limit switch as described above, however, is that the paper end can be detected easily and reliably.

The support plate 110 assembled to the back end of the bottom 81 could also be formed unitarily with the bottom 81.

As will be obvious from the preceding description, a printer according to the present invention uses a movable divider to set one side of the roll paper compartment, and enables a remaining paper detector to be assembled to this divider. The divider can also be removed to install an after-market remaining paper detector to the divider, and installing an after-market remaining paper detector is therefore simple. Installing and adjusting the remaining paper detector is also easier because the position of the remaining paper detector on the divider can be adjusted with the divider removed from the printer.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer having a roll paper compartment for housing a recording paper roll, the roll paper compartment comprising:

a bottom panel;

a fixed side panel defining one side of the roll paper compartment in alignment with the width of the printer parallel to its longitudinal axis; and a movable divider defining another side of the roll paper compartment in substantial alignment with the width of the printer with said movable divider located opposite said fixed side panel and having one or more connecting member(s) for detachably connecting said movable divider to said bottom panel such that said movable divider can assume a plurality of different positions laterally displaced from one another in alignment with said fixed side panel to adjustably accommodate different widths of roll paper and to facilitate placement of a remaining paper detector in the roll paper compartment for detecting if the paper remaining on the paper roll is less than or equal to a predetermined amount;

said movable divider being removably assembled to the bottom panel and having a detector mounting part for removably installing said remaining paper detector;

wherein the divider is removably connected to one of a multiple number of positions in said roll paper compartment space apart along the bottom panel for adjusting the location of the divider widthwise to the printer;

wherein the divider comprises a plurality of protruding pins or a plurality of recessed holes; and wherein the bottom panel has a set of complementary holes for inserting the pins, or a set of complementary pins for insertion into the recessed holes, at a selected one of the multiple positions widthwise to the printer.

* * * * *